United States Patent [19]

Francois

[11] Patent Number: 4,619,835

[45] Date of Patent: Oct. 28, 1986

[54] OPTIMIZING PROCESS AND DEVICE IN A PROCESS FOR REDUCING THE SIZE OF THE FLOWERING OF A GALVANIZED STEEL STRIP

[75] Inventor: Bernard Francois, Creil, France

[73] Assignee: Usinor, Puteaux, France

[21] Appl. No.: 744,578

[22] Filed: Jun. 14, 1985

[30] Foreign Application Priority Data

Jun. 22, 1984 [FR] France ..... 84 09910

[51] Int. Cl.[4] ..... B05B 7/00; B05C 5/00; B05C 11/00; B05C 19/00

[52] U.S. Cl. ..... 427/8; 118/308; 118/712; 427/192; 427/328

[58] Field of Search ..... 118/308, 667, 694, 712; 427/8, 192, 433, 328

[56] References Cited

U.S. PATENT DOCUMENTS 4,502,408 3/1985 Hennechart et al. ..... 118/308 X

FOREIGN PATENT DOCUMENTS 1446335 6/1966 France .

*Primary Examiner*—Michael R. Lusignan

*Attorney, Agent, or Firm*—Cushman, Darby & Cushman

[57] ABSTRACT

The process for optimizing the solidification of zinc on a steel strip (2) under the action of germs of crystallization constituted by zinc in the form of a fine powder, which are projected by a conveying fluid inside a case (1) onto the two sides of the strip (2), is characterized in that the temperature of the strip at the exit of the case (1) is measured and this temperature is maintained at an optimal value by regulating the flow of air blown into the case as a function of the difference between the measurement obtained and the optimal temperature.

8 Claims, 2 Drawing Figures

OPTIMIZING PROCESS AND DEVICE IN A PROCESS FOR REDUCING THE SIZE OF THE FLOWERING OF A GALVANIZED STEEL STRIP

The present invention relates to an optimizing process and device in a process for reducing the size of the flowering of a galvanized steel strip.

In modern continuous galvanization lines, the steel strip, after having undergone a heat treatment, is plunged in a bath of molten zinc.

The coating of liquid zinc is then wiped either by rollers on low production lines, or more generally by the effect of the pressure of jets of air or gas on the high production lines, then it becomes set under the effect of the natural cooling of the surrounding air.

In the course of its solidification, the zinc forms crystals having large facettes which are oriented in different directions and which together suggest flowers. This "flowering" is characteristic of the appearance of conventional galvanized sheets.

The flowering of galvanized strips is not acceptable, in particular in certain applications in which the metal sheet is painted, since the pattern of the flowers shows through the coating of paint.

Attempts have therefore been made to eliminate the formation of the flowering.

For this purpose, there has been proposed in the Pat. No. FR 1 446 335 a process which comprises supplying to the film of liquid zinc just before its solidification a large number of germs (i.e. means providing nucleation sites) of crystallization. The density per unit area of these germs determines the final appearance of the surface of the strip. In this way, it is possible to obtain a very fine crystallization with crystals reaching 0.1 mm as against 15 to 25 mm with the normal flowering.

The germs are formed by zinc in a fine powder which is conveyed by the air.

The mean particle size is usually about 5$\mu$.

These germs are projected onto the two sides of the strip travelling vertically by means of two horizontal blowing slots disposed on each side of the sheet and occupying a central position respectively in two semi-cases, each semi-case also including in the upper and lower parts, two take-off slots which are symmetrical relative to the blowing slot. A recirculation fan supplies the blowing slots with air and the inlet of the fan is connected to the take-off slots. Zinc powder is continuously supplied to the inlet of the fan.

The setting of the coating occurs inside the case in the presence of the crystallization germs conveyed in the air issuing from the blowing slots.

In order to achieve an optimal result in the reduction in the size of the flowering by this process, it is of prime importance to achieve perfect coincidence between the moment at which the germs of crystallization are presented and the precise moment preceding the solidification of the zinc. This coincidence is not always achieved and in this case the following alternative is presented:

- the zinc is already solidified upon its entrance into the case and the zinc powder has no effect;
- the zinc is still liquid at the outlet of the case and there is a melting of the zinc powder which cannot perform its function of a germ of crystallization.

In these two cases, the object is not attained.

In order to obtain the best conditions for producing a minimized flowering, certain means employed have already been described: it concerns, in respect of high production lines, a pre-cooling case and/or more generally a regulation of the height of the case.

The regulation of the height of the case may be effective if the range of the regulation encompasses the whole of the production of the line. On the other hand, it concerns a manual regulation which cannot have the reliability of an automatic regulation.

An object of the present invention is to improve the "mini-flowering" process by a regulation of the temperature of the galvanized steel strip.

Consequently, the present invention provides a process for optimizing the solidification of the zinc on a steel strip under the action of germs of crystallization, constituted by zinc in the form of a fine powder which is projected by a conveying fluid inside a spraying case onto the two sides of the strip, wherein the temperature of the strip is measured at the exit of the case and this temperature is maintained at an optimal value by regulating the flow of the conveying fluid in the case as a function of the difference between the measurement of the obtained temperature and the optimal temperature.

With this process, an increase of the temperature of the strip will result in an increase in the flow of the conveying fluid and a decrease in the temperature will result in a reduction in this flow. The conveying fluid is appropriately air but may be any inert gas.

This permits achieving a good coincidence between the projection of the zinc powder and the moment at which the zinc pre-solidifies on the strip inside the case, irrespective of variations in the speed of the production line, in the temperature of the zinc bath, in the thickness of the coating, etc. The set temperature may be a few degrees higher than the temperature of solidification of the zinc (419° C.).

It is unnecessary to know or measure with precision the optimal temperature at the exit of the case, since it is sufficient to regulate the optimal set temperature as a function of the best appearance obtained under stable operating conditions of the production line. Any variation in these conditions which would result in a variation in the temperature of the strip at the exit of the bath and consequently in the case, would have for consequence the correction of the temperature by the system regulating the flow of blown air.

According to a preferred manner of carrying out the process of the invention, the temperature is maintained at an optimal value by subjecting the strip, upstream of the spraying case, to a pre-cooling by means of a cooling fluid controlled by the measurement of the temperature effected at the exit of the case.

Thus, in the case of a pre-cooling, the temperature is regulated in cascade manner and the regulation is effected in the following manner:

- opening of the air circulation to the maximum, then opening and regulation of the pre-cooling.

In the case of a regulation of the case in height, with or without pre-cooling, there may be added "too hot" and "too cold" signals which indicate to the operator the direction of displacement of the case upwardly or downwardly.

The invention will be described hereinafter in more detail with reference to the accompanying drawings which show only one embodiment of the invention, and in which.

Figure 1:
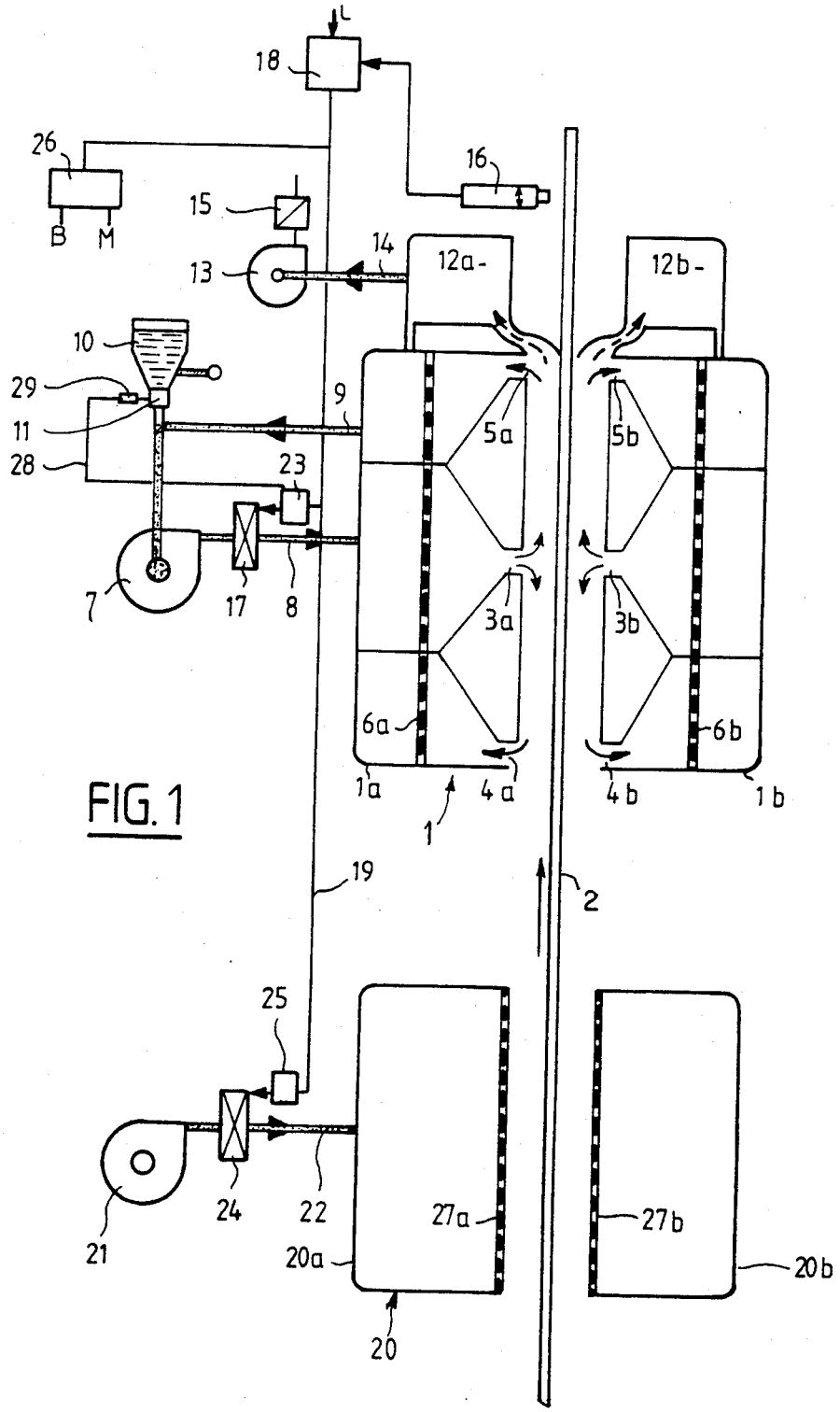
FIG. 1 is a diagram of an installation for carrying out the process according to the invention.

The installation shown in FIG. 1 comprises a case 1 formed by two semi-cases 1*a* and 1*b* which are identical and disposed vertically between which a galvanized steel strip 2 travels vertically.

The galvanized steel strip 2 enters the lower part of the case 1 while the zinc with which it is coated is still in a molten state. Each semi-case 1*a* and 1*b* has in its centre a horizontal blowing slot 3*a*, 3*b*, and at its lower and upper ends, take-off slots 4*a*, 4*b* and 5*a*, 5*b* respectively, through which the non-fixed zinc powder is re-aspirated.

A recirculation fan 7 supplies air to the blowing slots 3*a*, 3*b* through a pipe 8 in which is inserted a flow regulating device 17. The intake of the fan is connected to the take-off slots 4*a*, 4*b* and 5*a*, 5*b* through a pipe 9.

In order to ensure a correct distribution of the blowing and of the take-off, perforated walls 6*a*, 6*b* are interposed in each part of the case between the slots and the connection to the pipes 8 and 9.

A fine zinc powder (having a mean particle size of 5μ) is continuously fed to the inlet of the fan 7 from a storage hopper 10 through a powder metering device 11.

The outlet of the case (the upper part) is provided with aspiration hoods 12*a*, 12*b* whose function is to aspirate the residual zinc powder which has not been aspirated through the take-off slots 5*a*, 5*b*, these hoods 12*a*, 12*b* being connected to the inlet of a fan 13 through a pipe 14. A filter 15 is disposed at the outlet of the fan 13.

At the outlet of the case 1 there is disposed an apparatus 16 for optically measuring the temperature of the strip, this apparatus delivering a signal and being in particular of the radiation pyrometer type.

The signal obtained is sent to a regulation device 18 which compares it with a reference or set value C representing the optimal value of temperature. The output signal of the regulation device is then employed as will be described hereinafter. This regulation device is in particular of the derived integral proportional type.

In the preferred embodiment of the invention shown in FIG. 1, the installation comprises, upstream of the spraying case 1, a pre-cooling case 20 which consists of two semi-cases 20*a* and 20*b* disposed vertically on each side of the steel strip 2 between which the latter travels.

The steel strip 2 enters the lower part of the case 20 while the zinc coating is still in the molten state. Each semi-case 20*a*, 20*b* includes a perforated plate 27*a* and 27*b* which ensures an even blowing of air onto the coated steel strip 2 so as to pre-cool the latter.

The pre-cooling fan 21 supplies air to the parts 20*a* and 20*b* of the case 20 through a pipe 22 on which a flow regulating device 24 is mounted.

The output signal of the regulating device 18 is sent through a line 19 to control elements 23 and 25, respectively, of flow regulating elements 17 and 24, regulating the flow of the air sent to the spraying case 1 and the pre-cooling case 20. The control elements 23 and 25 are of the current (or voltage) divider type commonly known as "ratiobias" delivering a proportional signal below or above a certain threshold value.

The regulations are carried out in the following manner:

Upon an increase in the temperature detected by the pyrometer 16, the regulator 18 will deliver a new signal which, when processed in the "ratiobias" devices 23 and 25, will cause first of all the opening of the regulating element 17 regulating the recirculation air flow and then, the latter being in its maximum opening position, it will cause an opening of the element 24 regulating the flow of pre-cooling air.

Upon a drop in the temperature detected by the pyrometer 16, the regulating device 18 will deliver a new signal which, when processed in the "ratiobias" 23 and 25, will first of all cause the closure of the regulating element 24 regulating the flow of pre-cooling air, then, as the latter is completely closed, will cause the closure of the element 17 regulating the flow of the recirculation air.

Figure 2:
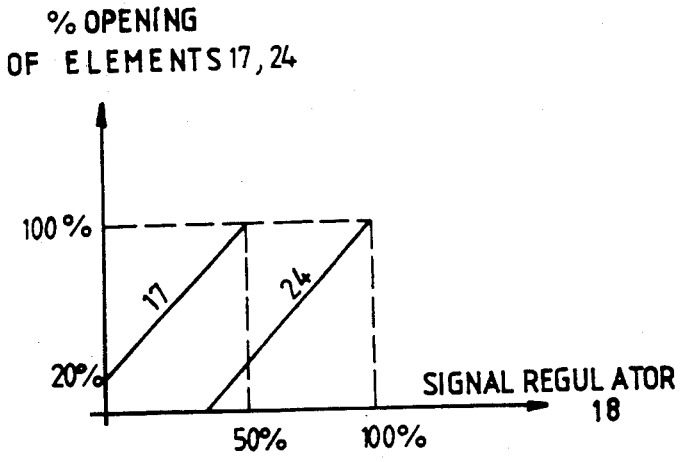
FIG. 2 is a diagram illustrating the principle of operation of the opening of the valves of the regulating device according to the invention.

The "ratiobias" devices 23 and 25 may be regulated in such manner that there is a slight overlapping between the maximum opening of the regulating element 17 for the recirculation air flow, and the minimum opening of the element 24 regulating the flow of pre-cooling air. The diagram of of the operation in the cascade or "split-range" manner of the elements 17 and 24 regulating the air flows is shown in FIG. 2.

The control element 23 also controls through a line 28 the powder metering device 11 by varying the speed of rotation of the motor 29 driving this device 11, as a function of the opening of the element 17 regulating the air flow.

According to a modification, the spraying case is provided with means for effecting a vertical movement in translation along the strip 2 which are controlled by an operator as a function of the output signal of the regulating element 18.

A threshold comparator 26 is branch-connected to the output signal of the regulating element 18. It will be regulated in such manner that, when this signal is above a value about equal to 90% (M), an alarm warns the operator that he must raise the case 1 and, on the other hand, when the signal drops below a value in the neighbourhood of 45% (B), another alarm indicates to the operator that he must lower the case.

The spraying case 1 may be regulated in height in an entirely automatic manner by using the threshold comparator 26 and the alarms mentioned hereinbefore. In order to avoid permanent displacements of the spraying case 1, an electric relay system will control the displacements by steps. Thus, the "raise" alarm will automatically control a raising of the spraying case 1 through, for example, one meter. This operation will be repeated a few instants later if the "raise" alarm persists. The same procedure will be adopted in the case of the "lower" alarm: the "lower" alarm will automatically control a lowering, for example through one meter, of the spraying case 1, which operation will be repeated a few instants later if the "lower" alarm persists.

I claim:

1. A process for optimizing solidification of zinc on a steel strip comprising employing germs of crystallization constituted by zinc in the form of a fine powder, blowing said germs by means of a conveying fluid inside a spraying case onto opposite sides of the strip, measuring the temperature of the strip adjacent a strip exit of the spraying case, and maintaining said temperature at an optimal value by regulating the rate of flow of said blown fluid as a function of the difference between the measurement of the obtained temperature and an optimal temperature for said process.

2. A process according to claim 1, comprising subjecting the strip to a pre-cooling by means of a cooling fluid controlled by said temperature measurement effected at said exit of said case.

3. A process according to claim 1, wherein said fluid is air.

4. A device for optimizing solidification of zinc on a steel strip under the action of germs of crystallization constituted by zinc in the form of a fine powder, comprising a spraying case for receiving the strip, means for blowing said fine powder in a conveying fluid in said case on opposite sides of the strip, a valve for regulating the flow of said fluid and said powder, an element connected to the valve for actuating said valve, a temperature measuring apparatus located downstream of said case relative to the direction of travel of said strip through said case for controlling said element.

5. A device according to claim 4, further comprising a pre-cooling case for pre-cooling the strip located upstream of said case relative to the direction of travel of said strip through said case, said pre-cooling case including second means for blowing a cooling fluid, an element connected to said second blowing means for actuating said second blowing means and connected to said regulating dcvice.

6. A device according to claim 4, comprising a support movable in translation relative to said strip and carrying said spraying case, a threshold detector branch-connected to said regulating device being connected to said support for controlling said movement in translation.

7. A device according to claim 5, comprising a support movable in translation relative to said strip and carrying said spraying case, a threshold detector branch-connected to said regulating device being connected to said support for controlling said movement in translation.

8. A device according to claim 4, wherein the regulating device is of the derived integral proportional type.

* * * * *